US009267690B2

(12) United States Patent
Stoia et al.

(10) Patent No.: US 9,267,690 B2
(45) Date of Patent: Feb. 23, 2016

(54) TURBOMACHINE COMBUSTOR NOZZLE INCLUDING A MONOLITHIC NOZZLE COMPONENT AND METHOD OF FORMING THE SAME

(75) Inventors: Lucas John Stoia, Taylors, SC (US); Patrick Benedict Melton, Horse Shoe, NC (US); Thomas Edward Johnson, Greer, SC (US); Christian Xavier Stevenson, Inman, SC (US); John Drake Vanselow, Taylors, SC (US); James Harold Westmoreland, Greer, SC (US)

(73) Assignee: General Electric Company, Schenectady, NY (US)

( * ) Notice: Subject to any disclaimer, the term of this patent is extended or adjusted under 35 U.S.C. 154(b) by 940 days.

(21) Appl. No.: 13/482,540

(22) Filed: May 29, 2012

(65) Prior Publication Data

US 2013/0318975 A1 Dec. 5, 2013

(51) Int. Cl.
*F23R 3/28* (2006.01)
*F23R 3/32* (2006.01)

(52) U.S. Cl.
CPC ..... *F23R 3/283* (2013.01); *F23R 3/286* (2013.01); *Y10T 29/49323* (2015.01)

(58) Field of Classification Search
CPC ..... F02C 7/22; F02C 7/222; F02C 7/24; F23R 3/04; F23R 3/045; F23R 3/10; F23R 3/28; F23R 3/286; F23R 3/283; F23R 3/30; F23R 3/32; F23R 2900/00014; F23R 2900/00017; F23R 2900/00018; F04D 2260/963; F04D 2230/21; F04D 2230/211; F04D 2230/51; F04D 2230/53; F04D 2230/10; F04D 2230/14
See application file for complete search history.

(56) References Cited

U.S. PATENT DOCUMENTS

| | | | | |
|---|---|---|---|---|
| 3,878,992 | A | | 4/1975 | MacManus |
| 4,100,733 | A | * | 7/1978 | Striebel et al. ..... 60/39.463 |
| 4,262,482 | A | | 4/1981 | Roffe et al. |
| 4,378,744 | A | | 4/1983 | DeFeo et al. |
| 4,408,461 | A | | 10/1983 | Bruhwiler et al. |
| 4,429,527 | A | | 2/1984 | Teets |
| 4,490,171 | A | | 12/1984 | Suzuki et al. |

(Continued)

FOREIGN PATENT DOCUMENTS

CN 1884910 A 12/2006

OTHER PUBLICATIONS

Chinese Office Action for CN Application No. 200910224888.6, dated Jun. 6, 2013, pp. 1-16.

(Continued)

*Primary Examiner* — Andrew Nguyen
(74) *Attorney, Agent, or Firm* — Ernest G. Cusick; Hoffman Warnick LLC

(57) ABSTRACT

A turbomachine combustor nozzle includes a monolithic nozzle component having a plate element and a plurality of nozzle elements. Each of the plurality of nozzle elements includes a first end extending from the plate element to a second end. The plate element and plurality of nozzle elements are formed as a unitary component. A plate member is joined with the nozzle component. The plate member includes an outer edge that defines first and second surfaces and a plurality of openings extending between the first and second surfaces. The plurality of openings are configured and disposed to register with and receive the second end of corresponding ones of the plurality of nozzle elements.

17 Claims, 5 Drawing Sheets

(56) References Cited

U.S. PATENT DOCUMENTS

| | | | | |
|---|---|---|---|---|
| 4,607,487 | A * | 8/1986 | Tilston | 60/752 |
| 4,763,481 | A | 8/1988 | Cannon | |
| 4,845,952 | A | 7/1989 | Beebe | |
| 4,854,952 | A * | 8/1989 | Stepien | 96/105 |
| 4,967,561 | A | 11/1990 | Bruhwiler et al. | |
| 4,986,068 | A | 1/1991 | Lee et al. | |
| 5,000,004 | A | 3/1991 | Yamanaka et al. | |
| 5,193,346 | A | 3/1993 | Kuwata et al. | |
| 5,199,265 | A | 4/1993 | Borkowicz | |
| 5,235,814 | A | 8/1993 | Leonard | |
| 5,247,797 | A | 9/1993 | Fric et al. | |
| 5,259,184 | A | 11/1993 | Borkowicz et al. | |
| 5,263,325 | A | 11/1993 | McVey et al. | |
| 5,277,022 | A | 1/1994 | Shekleton et al. | |
| 5,321,951 | A | 6/1994 | Falls et al. | |
| 5,339,635 | A | 8/1994 | Iwai et al. | |
| 5,400,968 | A | 3/1995 | Sood | |
| 5,475,979 | A | 12/1995 | Oag et al. | |
| 5,490,378 | A | 2/1996 | Berger et al. | |
| 5,518,697 | A | 5/1996 | Dalla Betta et al. | |
| 5,575,146 | A | 11/1996 | Borkowicz et al. | |
| 5,590,529 | A | 1/1997 | Joshi et al. | |
| 5,657,632 | A | 8/1997 | Foss | |
| 5,680,766 | A | 10/1997 | Joshi et al. | |
| 5,685,139 | A | 11/1997 | Mick et al. | |
| 5,761,897 | A | 6/1998 | Kramer | |
| 5,778,676 | A | 7/1998 | Joshi et al. | |
| 5,865,030 | A | 2/1999 | Matsuhama | |
| 5,881,756 | A | 3/1999 | Abbasi et al. | |
| 5,930,999 | A | 8/1999 | Howell et al. | |
| 5,943,866 | A | 8/1999 | Lovett et al. | |
| 6,019,596 | A | 2/2000 | Knopfel et al. | |
| 6,174,160 | B1 | 1/2001 | Lee et al. | |
| 6,301,899 | B1 | 10/2001 | Dean et al. | |
| 6,363,724 | B1 | 4/2002 | Bechtel et al. | |
| 6,438,961 | B2 | 8/2002 | Tuthill et al. | |
| 6,442,939 | B1 | 9/2002 | Stuttaford et al. | |
| 6,453,673 | B1 | 9/2002 | Bechtel et al. | |
| 6,623,267 | B1 | 9/2003 | Golladay, Jr. | |
| 6,672,073 | B2 | 1/2004 | Wiebe | |
| 6,681,578 | B1 | 1/2004 | Bunker | |
| 6,813,889 | B2 | 11/2004 | Inoue et al. | |
| 6,895,755 | B2 | 5/2005 | Steinthorsson et al. | |
| 6,993,916 | B2 | 2/2006 | Johnson et al. | |
| 7,007,477 | B2 | 3/2006 | Widener | |
| 7,007,486 | B2 | 3/2006 | Sprouse et al. | |
| 7,107,772 | B2 | 9/2006 | Chen et al. | |
| 7,165,405 | B2 | 1/2007 | Stuttaford et al. | |
| 7,185,494 | B2 | 3/2007 | Ziminsky et al. | |
| 7,237,384 | B2 | 7/2007 | Stuttaford et al. | |
| 7,246,494 | B2 | 7/2007 | Currin et al. | |
| 7,412,833 | B2 | 8/2008 | Widener | |
| 7,506,510 | B2 | 3/2009 | Thomson | |
| 7,540,154 | B2 | 6/2009 | Tanimura et al. | |
| 7,556,031 | B2 | 7/2009 | Russell | |
| 7,610,759 | B2 | 11/2009 | Yoshida et al. | |
| 7,707,833 | B1 | 5/2010 | Bland et al. | |
| 7,832,212 | B2 | 11/2010 | Bunker | |
| 7,886,991 | B2 | 2/2011 | Zuo et al. | |
| 8,007,274 | B2 | 8/2011 | Johnson et al. | |
| 8,042,339 | B2 | 10/2011 | Lacy et al. | |
| 8,147,121 | B2 | 4/2012 | Lacy et al. | |
| 8,157,189 | B2 | 4/2012 | Johnson et al. | |
| 2003/0010032 | A1 | 1/2003 | Stuttaford et al. | |
| 2005/0050895 | A1 | 3/2005 | Dorr et al. | |
| 2006/0010878 | A1 | 1/2006 | Widener | |
| 2006/0213178 | A1 | 9/2006 | Storey et al. | |
| 2007/0062197 | A1 | 3/2007 | Hannum et al. | |
| 2007/0074518 | A1 | 4/2007 | Rogers et al. | |
| 2007/0169992 | A1* | 7/2007 | Wasif et al. | 181/293 |
| 2008/0053097 | A1 | 3/2008 | Han et al. | |
| 2008/0078160 | A1 | 4/2008 | Kraemer et al. | |
| 2008/0078183 | A1 | 4/2008 | Ziminsky et al. | |
| 2009/0084110 | A1 | 4/2009 | Dudebout et al. | |
| 2009/0229269 | A1 | 9/2009 | Lacy et al. | |
| 2009/0241508 | A1 | 10/2009 | Davis, Jr. et al. | |
| 2009/0249789 | A1 | 10/2009 | Zuo et al. | |
| 2010/0008179 | A1 | 1/2010 | Lacy et al. | |
| 2010/0031662 | A1 | 2/2010 | Zuo | |
| 2010/0092896 | A1* | 4/2010 | Barton et al. | 431/2 |
| 2010/0101229 | A1 | 4/2010 | York et al. | |
| 2010/0139280 | A1 | 6/2010 | Lacy et al. | |
| 2010/0186413 | A1 | 7/2010 | Lacy et al. | |
| 2010/0192579 | A1 | 8/2010 | Boardman et al. | |
| 2010/0192581 | A1 | 8/2010 | Ziminsky et al. | |
| 2010/0192582 | A1 | 8/2010 | Bland et al. | |
| 2010/0218501 | A1* | 9/2010 | York et al. | 60/737 |
| 2010/0263383 | A1 | 10/2010 | York et al. | |
| 2010/0287937 | A1 | 11/2010 | Thatcher et al. | |
| 2011/0016871 | A1 | 1/2011 | Kraemer et al. | |
| 2011/0057056 | A1 | 3/2011 | Ziminsky et al. | |
| 2011/0083439 | A1* | 4/2011 | Zuo et al. | 60/737 |
| 2011/0113783 | A1 | 5/2011 | Boardman et al. | |
| 2011/0154829 | A1 | 6/2011 | Hayashi et al. | |
| 2012/0011854 | A1 | 1/2012 | Khan et al. | |
| 2013/0031906 | A1 | 2/2013 | Dicintio et al. | |
| 2013/0084534 | A1 | 4/2013 | Melton et al. | |
| 2013/0318976 | A1 | 12/2013 | Melton et al. | |

OTHER PUBLICATIONS

Extended European Search Report for EP Application No. 09176054.6-1602, dated Apr. 11, 2014, pp. 1-7.

Extended European Search Report for EP Application No. 12179234.5-1602, dated Dec. 13, 2013, pp. 1-7.

* cited by examiner

TURBOMACHINE COMBUSTOR NOZZLE INCLUDING A MONOLITHIC NOZZLE COMPONENT AND METHOD OF FORMING THE SAME

FEDERAL RESEARCH STATEMENT

This invention was made with Government support under Contract Number DE-FC26-05NT42643, awarded by the Department Of Energy. The Government has certain rights in this invention.

BACKGROUND OF THE INVENTION

The subject matter disclosed herein relates to the art of turbomachines and, more particularly, to a turbomachine combustor nozzle having a monolithic nozzle component.

In general, gas turbomachines combust a fuel/air mixture that releases heat energy to form a high temperature gas stream. The high temperature gas stream is channeled to a turbine portion via a hot gas path. The turbine portion converts thermal energy from the high temperature gas stream to mechanical energy that rotates a turbine shaft. The turbine portion may be used in a variety of applications, such as for providing power to a pump, an electrical generator, a vehicle, or the like.

In a gas turbomachine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. One method of achieving low NOx levels is to ensure good mixing of fuel and air prior to combustion. Another method of achieving low NOx levels is to employ higher reactivity fuels that produce fewer emissions when combusted at lower flame temperatures.

BRIEF DESCRIPTION OF THE INVENTION

According to one aspect of the exemplary embodiment, a turbomachine combustor nozzle includes a monolithic nozzle component having a plate element and a plurality of nozzle elements. Each of the plurality of nozzle elements includes a first end extending from the plate element to a second end. The plate element and plurality of nozzle elements are formed as a unitary component. A plate member is joined with the monolithic nozzle component. The plate member includes an outer edge that first and second surfaces and a plurality of openings extending between the first and second surfaces. The plurality of openings are configured and disposed to register with and receive the second end of corresponding ones of the plurality of nozzle elements.

According to another aspect of the exemplary embodiment, a method of forming a turbomachine nozzle includes forming a monolithic nozzle component having a plate member and a plurality of nozzle elements projecting axially outward from the plate member, positioning a plate element having a plurality of openings adjacent the nozzle component, registering the plurality of nozzle elements with respective ones of the plurality of openings, and joining the plurality of nozzle elements to the plate element.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
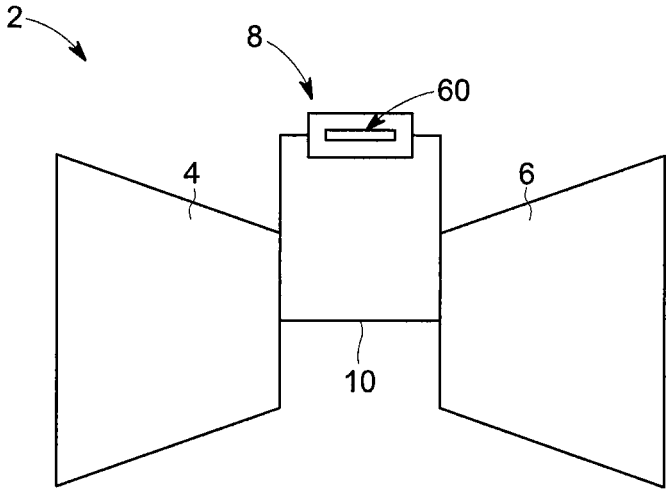
FIG. 1 is a partial cross-sectional side view of a turbomachine including a combustor assembly having a monolithic nozzle component in accordance with an exemplary embodiment.
Figure 2:
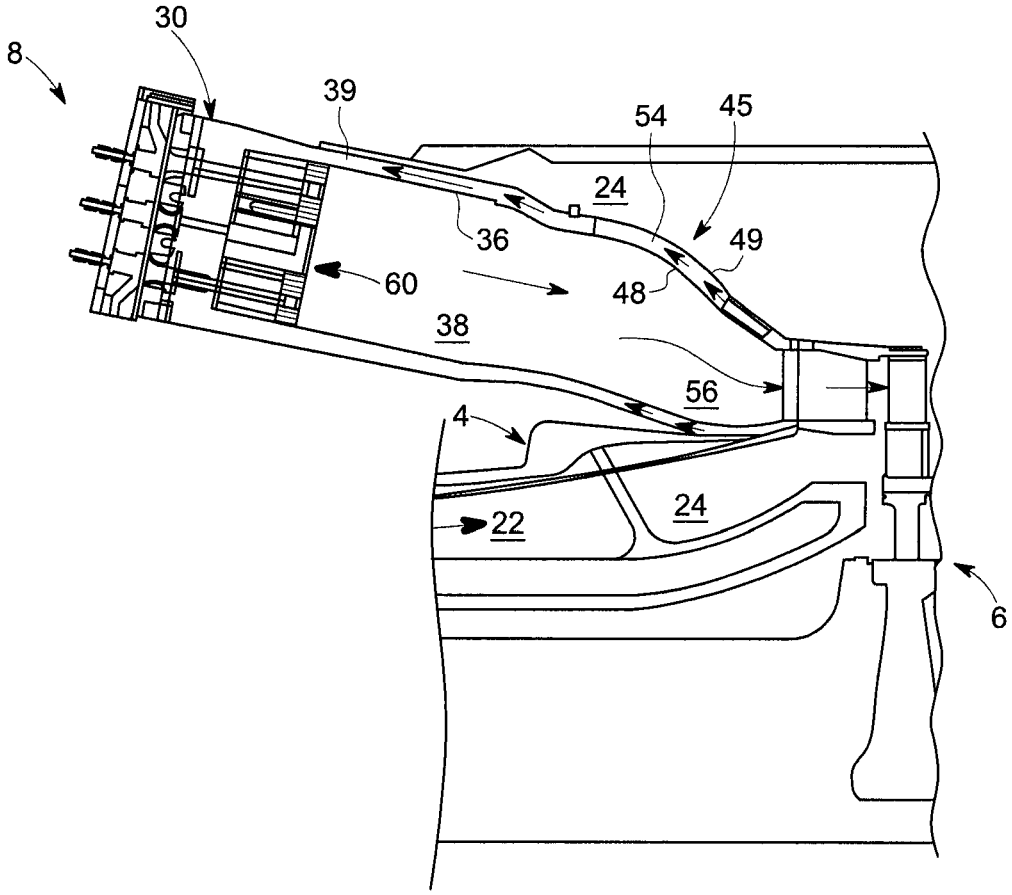
FIG. 2 is a cross-sectional view of the combustor assembly of FIG. 1 illustrating a nozzle assembly having a monolithic nozzle component in accordance with an exemplary embodiment.

With initial reference to FIGS. 1 and 2, a turbomachine constructed in accordance with an exemplary embodiment is indicated generally at 2. Turbomachine 2 includes a compressor portion 4 connected to a turbine portion 6 through a combustor assembly 8. Compressor portion 4 is also connected to turbine portion 6 via a common compressor/turbine shaft 10. Compressor portion 4 includes a diffuser 22 and a compressor discharge plenum 24 that are coupled in flow communication with each other and combustor assembly 8. With this arrangement, compressed air is passed through diffuser 22 and compressor discharge plenum 24 into combustor assembly 8. The compressed air is mixed with fuel and combusted to form hot gases. The hot gases are channeled to turbine portion 6. Turbine portion 6 converts thermal energy from the hot gases into mechanical rotational energy.

Combustor assembly 8 includes a combustor body 30 and a combustor liner 36. As shown, combustor liner 36 is positioned radially inward from combustor body 30 so as to define a combustion chamber 38. Combustor liner 36 and combustor body 30 collectively define an annular combustion chamber cooling passage 39. A transition piece 45 connects combustor assembly 8 to turbine portion 6. Transition piece 45 channels combustion gases generated in combustion chamber 38 downstream towards a first stage (not separately labeled) of turbine portion 6. Transition piece 45 includes an inner wall 48 and an outer wall 49 that define an annular passage 54. Inner wall 48 also defines a guide cavity 56 that extends between combustion chamber 38 and turbine portion 6. The above described structure has been provided for the sake of completeness, and to enable a better understanding of the exemplary embodiments which are directed to a nozzle assembly 60 arranged within combustor assembly 8.

Figure 3:
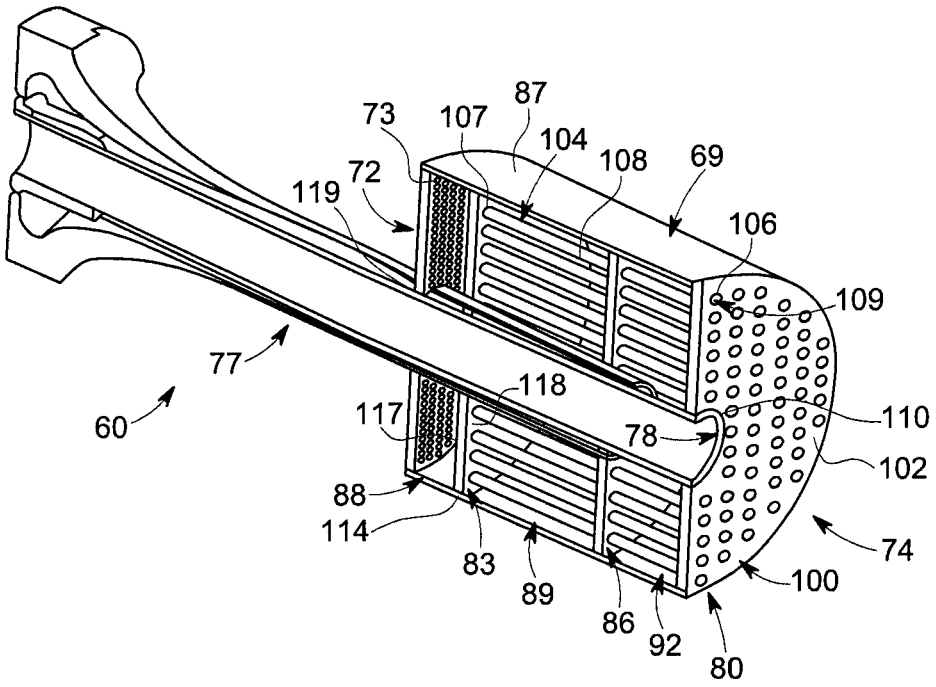
FIG. 3 is a cross-sectional view of a turbomachine nozzle in accordance with an exemplary embodiment.
Figure 4:
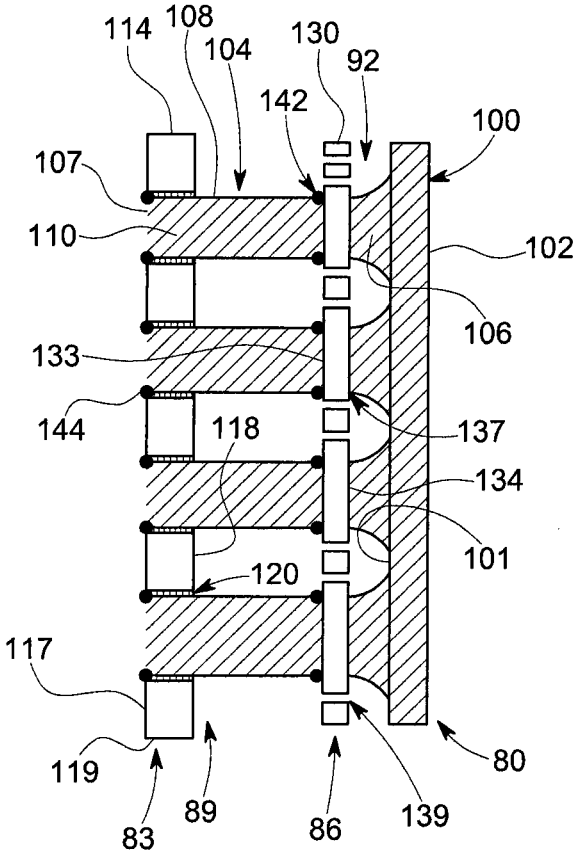
FIG. 4 is a partial cross-sectional view of an outlet portion of the turbomachine nozzle of FIG. 3 prior to forming a radial passage and a conduit.

Referring to FIGS. 3-4, nozzle assembly 60 includes a nozzle body 69 having a fluid inlet plate 72 provided with a plurality of openings 73. Nozzle body 69 is also shown to include an outlet 74 that delivers a combustible fluid into combustion chamber 38. A fluid delivery passage 77 extends through nozzle body 69 and includes an outlet section 78 that is fluidly connected to combustion chamber 38.

In accordance with an exemplary embodiment nozzle body 69 includes a monolithic nozzle component 80, a plate member 83, and a fluid flow conditioning plate member 86 joined by an outer nozzle wall 87. At this point it should be understood that the term "monolithic" describes a nozzle component that is formed without joints or seams such as through casting, direct metal laser sintering (DMLS), additive manufacturing, and/or metal molding injection. More specifically, monolithic nozzle component 80 should be understood to be formed using a process that results in the creation of a unitary component being devoid of connections, joints and the like as will be discussed more fully below. Of course, it should be understood that monolithic nozzle component 80 may be joined with other components as will also be discussed more fully below. As shown, fluid inlet plate 72 is spaced from plate member 83 to define a first fluid plenum 88, plate member 83 is spaced from fluid flow conditioning plate member 86 to define a second fluid plenum 89, and fluid flow conditioning plate member 86 is spaced from monolithic nozzle component 80 to define a third fluid plenum 92.

In further accordance with an exemplary embodiment, monolithic nozzle component 80 includes a plate element 100 having a first surface section 101 and an opposing second surface section 102. Monolithic nozzle component 80 is also shown to include a plurality of nozzle elements, one of which is indicated at 104, which extend axially outward from first surface section 101. Each of the plurality of nozzle elements 104 include a first end 106 that extends from first surface section 101 to a second end 107 through an intermediate portion 108. First end 106 defines a discharge opening 109. First end 106 is also shown to include a central opening 110 that is configured to receive outlet section 78 of fluid delivery passage 77. At this point it should be understood that plate element 100 and the plurality of nozzle elements 104 are cast as a single unitary piece such that nozzle elements 104 are integrally formed with plate element 100. The forming of the plurality of nozzle elements 104 with plate element 100 advantageously eliminates numerous joints that could present stress concentration areas, potential leak points and the like. It should also be understood that nozzle elements 104 are formed having a solid core 112 that is drilled or machined as will be discussed more fully below.

In still further accordance with the exemplary embodiment, plate member 83 includes an outer edge 114 that defines first and second opposing surfaces 117 and 118. Plate member 83 is shown to include a central opening 119 that registers with outlets section 78 of fluid delivery passage 77 as well as a plurality of outlet openings 120. Outlet openings 120 are arrayed about central opening 119 and provide a passage for each of the plurality of nozzle elements 104 as will be detailed more fully below. Fluid flow conditioning plate member 86 includes an outer edge 130 that defines first and second opposing surface portions 133 and 134. Fluid flow conditioning plate member 86 includes a plurality of nozzle passages 137 that correspond to the plurality of nozzle elements 104 as well as a plurality of fluid flow openings 139. Fluid flow openings 139 create a metered flow of fluid, such as fuel, from third plenum 92, through fluid flow conditioning plate member 86 into second fluid plenum 89. The fuel then enters nozzle elements 104 to mix with air to form a premixed fuel that is discharged from outlet 74. As shown, fluid flow conditioning plate member 86 is joined to nozzle elements 104 through a plurality of weld beads, one of which is shown at 142. Similarly, nozzle elements 104 are joined to plate member 83 through a plurality of weld beads such as shown at 144. Of course, nozzle elements 104 could be joined to fluid flow conditioning plate member 86 and plate member 83 using a variety of processes.

Figure 5:
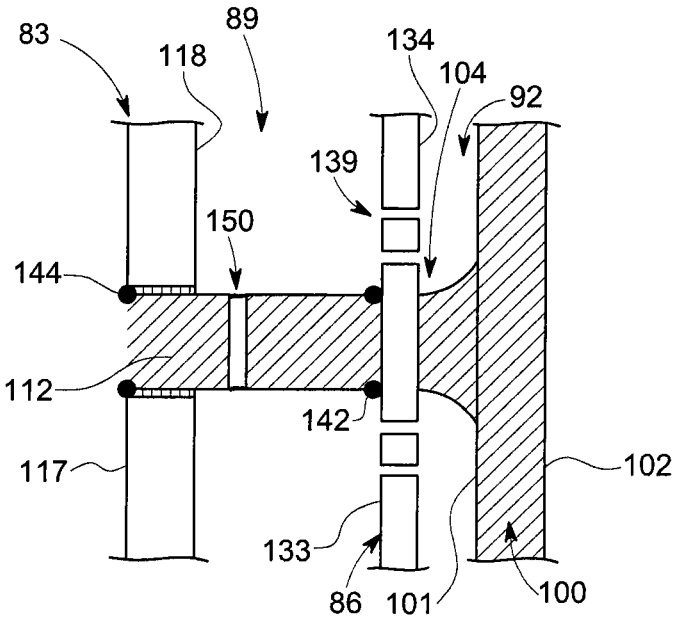
FIG. 5 is a cross-sectional view of a portion of the turbomachine nozzle of FIG. 4 after forming the radial passage.
Figure 6:
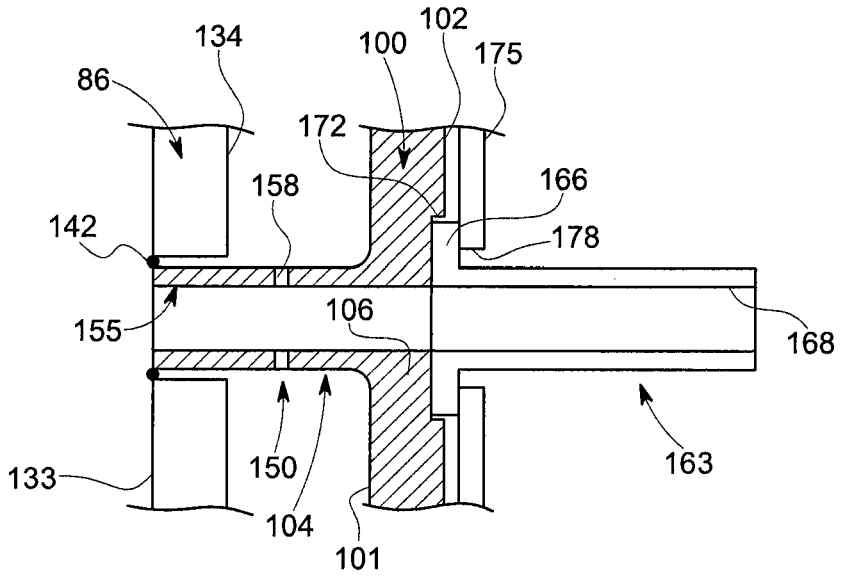
FIG. 6 is a cross-sectional view of a portion of the turbomachine nozzle of FIG. 4 after forming the conduit.

Reference will now be made to FIGS. 5 and 6 in describing details of nozzle elements 104. As shown, after forming, a radial passage 150 is formed in each nozzle element 104. Radial passage 150 extends through or bisects intermediate portion 108. In the exemplary aspect shown, radial passage 150 is formed so as to be fluidly connected with second fluid plenum 89. A conduit 155 is also formed axially through solid core 110 of each nozzle element 104. Conduit may be formed either before or after radial passage 150. If conduit 155 is formed before, radial passage 150 may be formed using an Electrical discharge Machining or EDM process from within conduit 155. In either case, conduit 155 bisects radial passage 150. In this manner, radial passage 150 constitutes a fluid inlet 158 to conduit 155. Conduit 155 defines a flow passage that extends between second end 107 (FIG. 3) and first end 106 to define discharge opening 109. With this arrangement, air may be passed into second end 107 from first fluid plenum 88. A fuel is introduced into second fluid plenum 87 and passed to third fluid plenum 92 via fluid flow openings 139. The fuel enters conduit 155 through radial passage 150 to form a combustible mixture that is introduced into combustion chamber 38.

In accordance with one aspect of the exemplary embodiment shown, nozzle assembly 60 is provided with a plurality of nozzle extensions, one of which is shown at 163, that project axially outward from second surface section 102. Each nozzle extension 163 includes a first or flanged end 166 that extends to a second or outlet end 168. With this arrangement, recesses, such as shown at 172, are formed in second surface section 102 about each discharge opening 109. Flanged end 166 is placed within recess 172 and held in place with a clamping plate 175. Clamping plate 175 includes a number of openings (not separately labeled) that are configured to register with and receive each nozzle extension 163. Of course it should be understood that nozzle extensions 163 could be joined to monolithic nozzle component 80 using a variety of processes.

Figure 7:
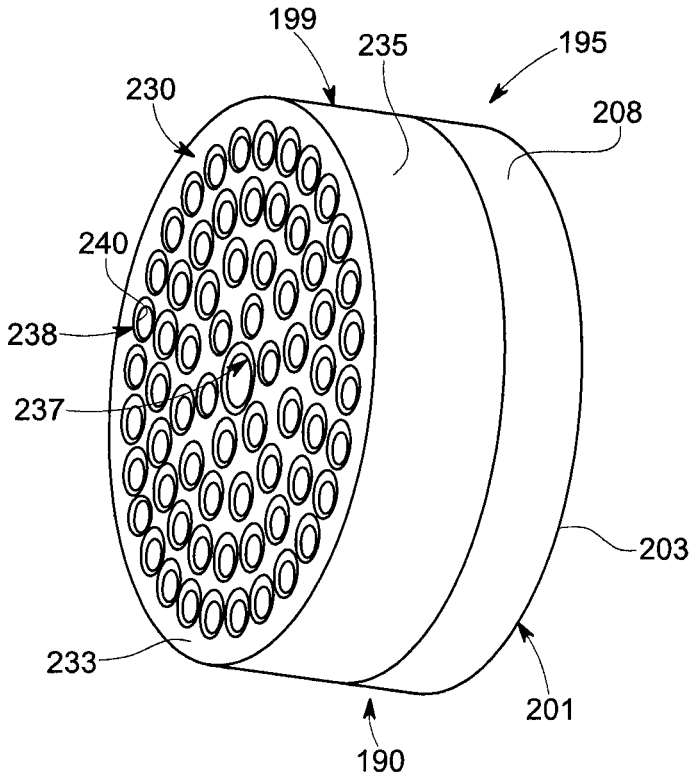
FIG. 7 is a perspective view of a turbomachine nozzle in accordance with another aspect of the exemplary embodiment.
Figure 8:
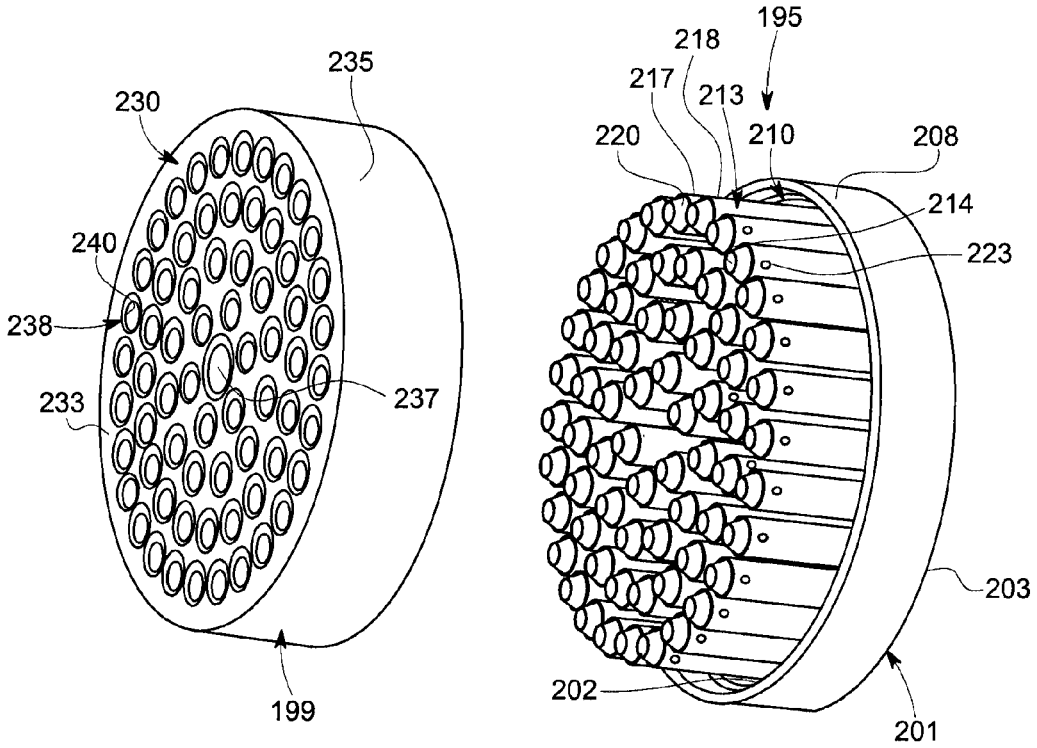
FIG. 8 is an exploded view of the turbomachine nozzle of FIG. 7.
Figure 9:
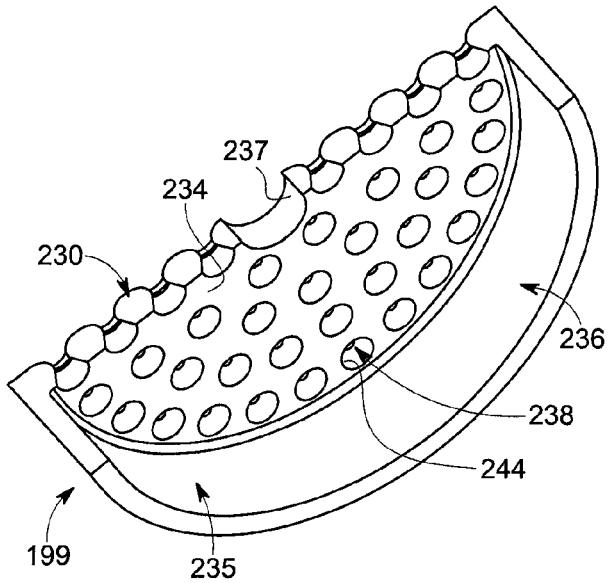
FIG. 9 is a partial perspective view of an inner surface of a cap member portion of the turbomachine nozzle of FIG. 7.

Reference will now be made to FIGS. 7-9 in describing a nozzle body 190 formed in accordance with another aspect of the exemplary embodiment. Nozzle body 190 includes a monolithic nozzle component 195 joined to a cap member 199. Monolithic nozzle component 195 includes a plate element 201 having first and second opposing surface sections 202 and 203. Monolithic nozzle component 195 is further shown to include an annular wall member 208 that extends about plate element 201 and defines a first plenum portion 210. Monolithic nozzle component 195 is also shown to include a plurality of nozzle elements 213 that project axially outward from first surface section 202. In a manner similar to that described above, plate element 201, wall member 208 and nozzle elements 213 are formed as a single unitary component. However, in contrast to the previously discussed embodiment, each nozzle element 213 is cast with a central passage 214 that extends from a first end (not shown) exposed at second surface section 203 to a second end 217 through an intermediate portion 218. Second end 217 includes a tapered region 220 that cooperates with structure on cap member 199 as will be discussed more fully below. In addition, each nozzle element 213 is provided with a fluid inlet, one of which is shown at 223, that extends through intermediate portion 218 at second end 217.

In further accordance with the exemplary embodiment shown, cap member 199 includes a plate member 230 having first and second opposing surfaces 233 and 234. Cap member 199 is also shown to include a wall portion 235 that extends about and projects axially outward from second surface 234. Wall portion 235 defines a second plenum portion 236. Plate member 230 includes a central opening 237 that fluidly connects with outlet section 78 of fluid delivery passage 77 as well as a plurality of discharge openings 238. Each discharge opening 238 includes a tapered section 240 formed in first surface 233 and a tapered zone 244 formed in second surface 234. Tapered zone 244 is configured to receive tapered region 220 of each nozzle element 213. Tapered section 240 provides access to, for example, a laser that is used to weld second end 217 of each nozzle element 213 to cap member 199.

At this point it should be understood that the exemplary embodiments describe a turbomachine nozzle having a monolithic component that includes, as a single unified, integrally formed, unit, a plate element and a plurality of nozzle elements. Forming the nozzle elements together with the plate elements reduces the number of joints required to form the nozzle assembly. The reduction in joints eliminates many stress concentration areas as well as potential leak points. It should also be understood that the particular size, shape and number of nozzle elements may vary. It should be further understood that the geometry of the nozzle body may also vary as well as the location of the fluid inlet into each nozzle element.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine combustor nozzle comprising:

a monolithic nozzle component having a plate element and a plurality of nozzle elements, each of the plurality of nozzle elements including a first end extending from the plate element to a second end, the plate element and plurality of nozzle elements being formed as a unitary component, wherein the plate element includes a wall member, the wall member projecting axially outward from the plate element; and a plate member joined to the monolithic nozzle component, the plate member including an outer edge defining first and second surfaces and a plurality of openings extending between the first and second surfaces, the plurality of openings being configured and disposed to register with and receive the second end of corresponding ones of the plurality of nozzle elements, wherein the plate member comprises a cap member including a wall portion projecting axially outward from the second surface, the wall portion being configured and disposed to engage with the wall member to define a fluid plenum.

2. The turbomachine combustor nozzle according to claim 1, further comprising: a fluid flow conditioning plate member arranged between the plate element and the plate member, the fluid flow conditioning plate member having a first surface portion, a second surface portion and a plurality of nozzle passages extending between the first and second surface portions, the plurality of nozzle passages being configured and disposed to register with and receive corresponding ones of the plurality of nozzle elements.

3. The turbomachine combustor nozzle according to claim 2, wherein each of the plurality of nozzle elements includes a radial passage arranged between the plate element and the fluid flow conditioning plate member.

4. The turbomachine combustor nozzle according to claim 2, wherein the fluid flow conditioning plate member includes a plurality of fluid flow openings extending between the first and second surface portions.

5. The turbomachine combustor nozzle according to claim 1, wherein the plate element comprises an outlet of the turbomachine nozzle.

6. The turbomachine nozzle according to claim 1, wherein the second end of each of the plurality of nozzle elements includes a tapered region.

7. The turbomachine nozzle according to claim 6, wherein each of the plurality of openings includes a tapered zone formed in the second surface, the tapered zone being configured and disposed to receive the tapered region of each of the plurality of nozzle elements.

8. The turbomachine nozzle according to claim 7, wherein each of the plurality of openings includes a tapered section formed in the first surface.

9. A method of forming a turbomachine nozzle comprising:

forming a monolithic nozzle component having a plate element and a plurality of nozzle elements projecting axially outward from the plate element;

positioning a plate member having a plurality of openings adjacent the monolithic nozzle component;

registering the plurality of nozzle elements with respective ones of the plurality of openings;

forming a tapered region in an end of each of the plurality of nozzle elements;

forming a tapered zone in a surface of the plate member at each of the plurality of openings;

nesting the tapered region of each of the plurality of nozzle elements into corresponding ones of the tapered zone of the plate member;

forming a tapered section in an opposing surface of the plate member at each of the plurality of openings; and joining the end of each of the plurality of nozzle elements to the plate member through the tapered section.

10. The method of claim 9, wherein forming the monolithic nozzle component includes casting the plurality of nozzle elements with a solid core.

11. The method of claim 10, further comprising: forming a conduit through each of the plurality of nozzle elements.

12. The method of claim 11, further comprising: positioning a fluid flow conditioning plate member having a plurality of nozzle passages between the plate element and the plate member, the plurality of nozzle elements extending through respective ones of the plurality of nozzle passages.

13. The method of claim 12, further comprising: forming a radial passage in each of the plurality of nozzle elements between the plate element and the fluid flow conditioning plate member.

14. The method of claim 13, wherein forming the radial passage includes creating the radial passage from within the conduit.

15. The method of claim 9, wherein joining each of the plurality of nozzle elements to the plate member comprises welding each of the plurality of nozzle elements to the plate member at each of the plurality of openings.

16. The method of claim 9, further comprising: joining a wall member surrounding each of the plurality of nozzle elements with a wall portion projecting from the plate member.

17. A turbomachine combustor nozzle comprising:

a monolithic nozzle component having a plate element and a plurality of nozzle elements, each of the plurality of nozzle elements including a first end extending from the plate element to a second end, the plate element and plurality of nozzle elements being formed as a unitary component, wherein the plate element includes a wall member, the wall member projecting axially outward from the plate element, wherein the second end of each of the plurality of nozzle elements includes a tapered region; and a plate member joined to the monolithic nozzle component, the plate member including an outer edge defining first and second surfaces and a plurality of openings extending between the first and second surfaces, the plurality of openings being configured and disposed to register with and receive the second end of corresponding ones of the plurality of nozzle elements, wherein each of the plurality of openings includes a tapered zone formed in the second surface, the tapered zone being configured and disposed to receive the tapered region of each of the plurality of nozzle elements, wherein each of the plurality of openings includes a tapered section formed in the first surface.

* * * * *